US005400404A

United States Patent [19]

Miyagawa

[11] Patent Number: 5,400,404

[45] Date of Patent: Mar. 21, 1995

[54] MODULATION/DEMODULATION CIRCUIT AND COMMUNICATION SYSTEM UTILIZING THE SAME

[75] Inventor: Shozo Miyagawa, Kyoto, Japan

[73] Assignee: Rohm Co., Ltd., Kyoto, Japan

[21] Appl. No.: 939,592

[22] Filed: Sep. 2, 1992

[30] Foreign Application Priority Data

Sep. 10, 1991 [JP] Japan ..... 3-230512

[51] Int. Cl.[6] ..... H04K 1/04

[52] U.S. Cl. ..... 380/38; 380/9; 380/33

[58] Field of Search ..... 380/9, 28, 33, 38, 39

[56] References Cited

U.S. PATENT DOCUMENTS 2,530,579 11/1950 Körös ..... 380/39
4,195,202 3/1980 McCalmont ..... 380/39
5,140,635 8/1992 Houghton et al. ..... 380/38
5,168,522 12/1992 Simanis et al. ..... 380/38

*Primary Examiner*—Bernarr E. Gregory

*Attorney, Agent, or Firm*—Oliff & Berridge

[57] ABSTRACT

The present invention provides a modulation/ demodulation circuit and a communication system utilizing the modulation/demodulation circuit. The modulation/ demodulation circuit can be operated in either of a modulation/demodulation mode wherein an input signal is frequency inverted and scrambled or descrambled and a through mode wherein the input signal is directly outputted therefrom without being subject to any processing. In a private communication system, two such modulation/ demodulation circuits are used as a scrambler in the transmission-side and as a descrambler in the reception-side. In order to prevent the low band characteristic of the reception-side output in the through mode from being different from that of the modulation/-demodulation mode, the modulation/demodulation circuit may include a high pass filter. The high pass filter a low band cut-off characteristic reciprocal to a low pass filter for removing the upper side band from the output of a double balanced mixer.

25 Claims, 10 Drawing Sheets

INPUT SIGNAL

TRANSMITTER
HPF OUTPUT

TRANSMITTER
LPF OUTPUT

RECEIVER
HPF OUTPUT

OUTPUT SIGNAL

INPUT SIGNAL

TRANSMITTER
DBM OUTPUT

TRANSMITTER
LPE OUTPUT

RECEIVER
DBM OUTPUT

OUTPUT SIGNAL

PRIOR ART

INPUT SIGNAL

TRANSMITTER
LPF OUTPUT

OUTPUT SIGNAL

PRIOR ART

MODULATION/DEMODULATION CIRCUIT AND COMMUNICATION SYSTEM UTILIZING THE SAME

BACKGROUND OF THE INVENTION

Field of the Invention

The present invention relates to a modulation/-demodulation circuit usable in telephone scrambler or the like and a communication system utilizing such a modulation/demodulation circuit.

Description of the Related Art

There is known a modulation/demodulation circuit which uses a double balanced mixer (DBM). Such a modulation/demodulation circuit is used, for example, in a telephone scrambler.

FIG. 6 shows a modulation/demodulation circuit constructed in accordance with the prior art. The modulation/demodulation circuit generally shown by 10 comprises a DBM 14 which receives an input signal having its frequency (fin) and converts this input signal by the use of a carrier having its frequency (fcar) outputted from an oscillator 12. In other words, the DBM 14 converts the frequency (fin) into $|fcar \pm fin|$. The output stage of the DBM 14 is connected to an LPF 16 which is a filter for selectively passing only the lower side band (LSB) of the output of the DBM 14.

In the prior art modulation/demodulation circuit, a switch 18 is connected between the DBM 14 and the LPF 16. The switch 18 functions to switch the input of the LPF 16 from the output of the DBM 14 to the input signal or vice versa. For a scrambler, the switch 18 is manually switched by an operator. If the switch 18 is moved upwardly as viewed in FIG. 6, the circuit is placed in a modulation/demodulation mode wherein the output of the DBM 14 is fed to the LPF 16. If the switch 18 is moved downwardly, the circuit is placed in a through mode wherein the input signal is applied directly to the LPF 16 not via the DBM 14. Only in the modulation/demodulation mode, may the input signal to the LPF 16 be scrambled or unscrambled by the actuation of the DBM 14.

FIG. 7 shows a system connecting modulation/ demodulation circuits 10-T and 10-R by a transmission channel 20. Each of these modulation/demodulation circuits 10-T and 10-R has the same arrangement as that of the modulation/demodulation circuit 10 shown in FIG. 6.

FIGS. 8*a*–8*e* show signal conditions at various points in the circuit wherein modulation/demodulation mode, that is, a mode when switches 18-T and 18-R are shifted upwardly as viewed in FIG. 8. When an input signal is applied to the transmission-side modulation/demodulation circuit 10-T as shown in FIG. 8*a*, the output of a transmission-side DBM 14-T is frequency converted, as shown in FIG. 8*b*. More particularly, the frequency (fin) is converted into a frequency $|fcar \pm fin|$. A symbol "→" in FIG. 8 represents that the frequency components are arranged in the order of the original signal frequencies while a symbol "←" shows that the frequency components are arranged in the opposite order.

In the modulation/demodulation mode, a signal having frequency characteristic such as are shown in FIG. 8*b* is inputted to the LPF 16-T since the switch 18-T is shifted upwardly. The LPF 16-T has a cut-off characteristic which causes only frequency components having frequencies less than the carrier frequency (fcar) to be passed to the transmission channel 20. Namely, the LPF 16-T has a characteristic such as is shown by a broken line in FIG. 8*c*. The signal fed from the LPF 16-T to the transmission channel 20 will contain only the LSB of the output of the LPF 16-T, as shown in FIG. 8*c*. The LSB signal is a signal whose frequency components are arranged in the inverse order to the original signal.

As the output of the LPF 16-T is provided to the reception-side modulation/demodulation circuit 10-R through the transmission channel 20, DBM 14-R receives this signal and frequency converts it as in the transmission-side DBM 14-T. Thus, the output of the DBM 14-R becomes such a signal as is shown in FIG. 8*d*.

The output of the DBM 14-R is inputted to LPF 16-R through the switch 18-R. The LPF 16-R has the same cut-off characteristic as that of the LPF 16-T. Therefore, only the LSB of the output of the DBM 14-R will be outputted from the LPF 16-R. Namely, the output of the reception-side modulation/demodulation circuit 10-R will be such a signal as is shown in FIG. 8*e*.

In the through mode, tile switches 18-T and 18-R are shifted downwardly as viewed ill FIG. 7. The DBMs 14-T and 14-R are inoperative in the through mode. As a result, such a signal as is shown in FIG. 9*a* is directly input to the transmission-side LPF 16-T which in turn converts it into a signal having such a frequency as is shown in FIG. 9*b*. As this signal is applied to the reception-side LPF 16-R through the transmission channel 20, the reception-side LPF 16-R will output a signal having such a frequency characteristic as is shown in FIG. 9*c*.

In such a manner, an operator can manually shift the prior art modulation/demodulation circuit from the modulation/demodulation mode to the through mode or vice versa.

In such an arrangement, however, the frequency characteristic of the output signal will vary between the modulation/demodulation mode and the through mode. In the scrambler, the tone quality in the same output signal will become different between the modulation/-demodulation mode and the through mode, for example.

More particularly, the output signal shown in FIG. 8*e* becomes a signal having a substantially trapezoid-shaped frequency characteristic with the components near DC being cut off, since in the modulation/-demodulation mode the output of the transmission-side LPF is frequency inverted by the reception-side, as shown in FIGS. 8*c* and 8*d*. On the contrary, the frequency will not be inverted by the reception-side DBM in the through mode. Thus, the cut-off shape inverted by the transmission-side DBM will not appear at the lower band range. In other words, the frequency characteristic is flat towards the lower band range, as is shown in FIG. 9*c*.

SUMMARY OF THE INVENTION

It is therefore an object of the present invention to provide a modulation/demodulation circuit which can provide an invariable output signal both in the through and modulation/demodulation modes.

To this end, the present invention provides a communication system comprising:

A) a transmission-side device including:

a) a transmission-side frequency inverting means comprising:

a transmission-side mixing circuit for mixing an input signal with a sufficiently high frequency (fcar); and a transmission-side low-pass filter (LPF) for separating a lower side band (LSB), having a frequency spectrum inverted relative to the input signal to the transmission-side mixing circuit, from the output of the transmission-side mixing circuit, b) a transmission-side high-pass filter (HPF) having a low range cut-off characteristic reciprocal to the transmission-side LPF, and c) a transmission-side selecting means for selecting and transmitting an external input signal frequency inverted by the transmission-side frequency inverting means in the modulation mode and an external input signal filtered by the transmission-side LPF and HPF in the through mode, and B) a reception-side device comprising:

d) a reception-side frequency inverting means for inverting the frequency spectrum of a transmission signal inputted from the transmission-side device; and e) a reception-side selecting means for causing the reception-side frequency inverting means to frequency invert the transmission signal in the demodulation mode.

The communication system of the present invention can be operated by either of the modulation/demodulation and through modes.

When the transmission-side device is in the modulation mode, an input signal is first mixed with a signal having the frequency (fear) by the transmission-side mixing circuit. Since the frequency (fcar) is sufficiently high relative to the frequency (fin) of the input signal, the LSB frequency in the output of the mixing circuit becomes equal to $|fcar-fin|$. On the other hand, since the frequency of the upper side band (USB) is $|fcar+fin|$, the inversion of the frequency spectrum can be realized by removing the USB and leaving only the LSB which is done by the transmission-side LPF.

The signal having its inverted frequency spectrum is then inputted to the reception-side device. When the transmission-side device is in the modulation mode and if the reception-side device is in the demodulation mode, the inversion of frequency provided by the transmission-side device can be reversed. More particularly, in the demodulation mode, the input signal from the transmission-side device is frequency converted by the reception-side frequency inverting means with the frequency spectrum thereof being returned to the same order as that of the input signal to the transmission-side device.

When the transmission-side device is in the through mode, the input signal to the transmission-side device is filtrated by the transmission-side LPF and HPF before it is inputted to the reception-side device. Since this does not invert the frequency of the input signal, the reception-side device also does not invert the frequency of the input signal. Since the filtration is also carried out by the transmission-side LPF in the through mode, any high-frequency noise exceeding the frequency (fcar) is almost completely prevented from entering the reception-side device.

The feature of the present invention is the transmission-side HPF used in the through mode. This HPF can give substantially the same low band characteristic as that of the reception-side device output in tile modulation/demodulation mode to the output of the reception-side device in the through mode.

In the modulation/demodulation mode, the output of the transmission-side device near the frequency (fcar) has a cut-off frequency determined by the high band cut-off characteristic of the transmission-side LPF. If the output of the transmission-side device is frequency inverted directly by the reception-side device, therefore, a cut-off frequency reciprocal to the high band cut-off characteristic of the transmission-side LPF will appear on tile low band side of the output of the reception-side frequency inverting means (near the frequency 0).

Also in the through mode, a cut-off frequency determined by the high band cut-off characteristic of the transmission-side LPF appears on the high band side of the transmission-side device output. In addition, a cut-off frequency due to the transmission-side LPF appears on the low band side of the transmission-side device output. Since the output of the transmission-side device is not frequency inverted by the reception-side device in the through mode, a cut-off frequency due to the transmission-side LPF appears on the low band side of the output of the reception-side frequency inverting means. This low band cut-off characteristic of the transmission-side LPF is reciprocal to the high band cut-off characteristic of the transmission-side LPF. Therefore, the output of the reception-side device in the through mode will have substantially the same low band cut-off frequency as that of the reception-side device output in the modulation/demodulation mode.

In this connection, the characteristic reciprocal to the transmission-side LPF may be such a characteristic that is provided by converting the frequency axis (f) of the transmission-side low pass filter into $(-f+fcar)$. Moreover, it is sufficient for the reception-side device to have the same arrangement as that of the transmission-side device. For example, the reception-side frequency inverting means may be defined by the reception-side mixing circuit and LPF. The reception-side device may also include a reception-side HPF having the same characteristic as that of the reception-side LPF. In the latter case, the reception-side selecting means can function in the same manner as in the transmission-side selecting means.

The frequency inverting means may use a double balanced mixer (DBM) in place of the mixing circuit. The signal having the frequency (fcar) may be generated by any suitable oscillator.

Furthermore, the selecting means can be realized by the use of any suitable switch means.

The first preferable form of the selecting means may include a switch disposed between the transmission-side mixing circuit and the transmission-side LPF. In such a case, the input signal may be provided to both the mixing circuit and HPF while the LPF receives the output of the mixing circuit in the modulation mode and the output of the HPF in the through mode. Thus, the output of the LPF will be a desired output.

The second preferable form of the selecting means may include a first switch located at the forward stage of the frequency inverting means and a second switch disposed between the mixing circuit and the LPF. In this case, the input signal may be applied to both the HPF and first switch while the output of the first switch may be inputted to both the frequency inverting means and second switch. In the modulation mode, further, the first switch may be caused to input the input signal directly to the frequency inverting means while the second switch may be caused to input the output of the mixing circuit to the LPF. On the contrary, the first and second switches may be caused to input the output of the HPF to the LPF in the through mode. Thus, the output of the LPF will be a desired output.

The third preferable form of the selecting means may include a first switch disposed between the mixing circuit and the LPF and a second switch located at the rearward stage of the frequency inverting means. In this case, the input signal may be inputted to both the frequency inverting means and first switch while the output of the LPF may be inputted to both the second switch and HPF. Further, the first switch may be caused to input the output of the mixing circuit to the LPF in the modulation mode. On the contrary, the first switch may be caused to input the input signal to the LPF in the through mode. As a result, the modulation mode will provide the desired output of the LPF while the through mode will provide the desired output of the HPF. The second switch selects either of these desired outputs depending on the mode.

The present invention provides not only such a communication system but also a modulation/demodulation circuit. The modulation/demodulation circuit of the present invention can be used as-either of the transmission-side or reception-side devices. Therefore, the arrangement of the modulation/demodulation circuit will not further be described herein since it has been described in connection with the communication system.

The present invention can be specifically applied to private telephone sets or the like. More particularly, the modulation/demodulation circuit of the present invention can be used as a voice scrambler or descrambler.

BRIEF DESCRIPTION OF THE DRAWINGS

FIG. 3*b* showing the frequency characteristic of the transmission-side HPF output; FIG. 3*c* showing the frequency characteristic of the transmission-side LPF output; FIG. 3*d* showing the frequency characteristic of the reception-side HPF output; and FIG. 3*e* showing the frequency characteristic of the output signal.

FIG. 8*b* showing the frequency characteristic of the transmission-side LPF output; FIG. 8*c* showing the frequency characteristic of the transmission-side DBM output; FIG. 8*d* showing the frequency characteristic of the reception-side DBM output; and FIG. 8*e* showing the frequency characteristic of the output signal.

FIG. 9*b* showing the frequency characteristic of the transmission-side LPF output; and FIG. 9*c* showing the frequency characteristic of the output signal.

DETAILED DESCRIPTION OF THE PREFERRED EMBODIMENTS

Figure 1:
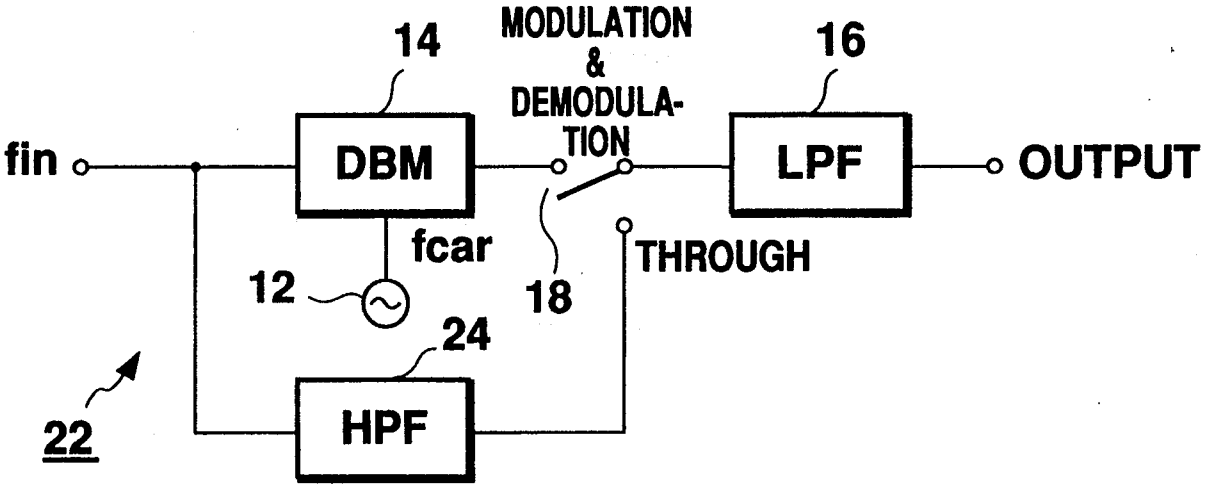
FIG. 1 is a block diagram of the first embodiment of a modulation/demodulation circuit constructed in accordance with the present invention.

The present invention will now be described in connection with some preferred embodiments thereof illustrated in the drawings. It is, however, to be understood that parts similar to those of the prior art shown in FIGS. 6 through 9*c* are denoted by similar reference numerals and will not be further described.

Figure 6:
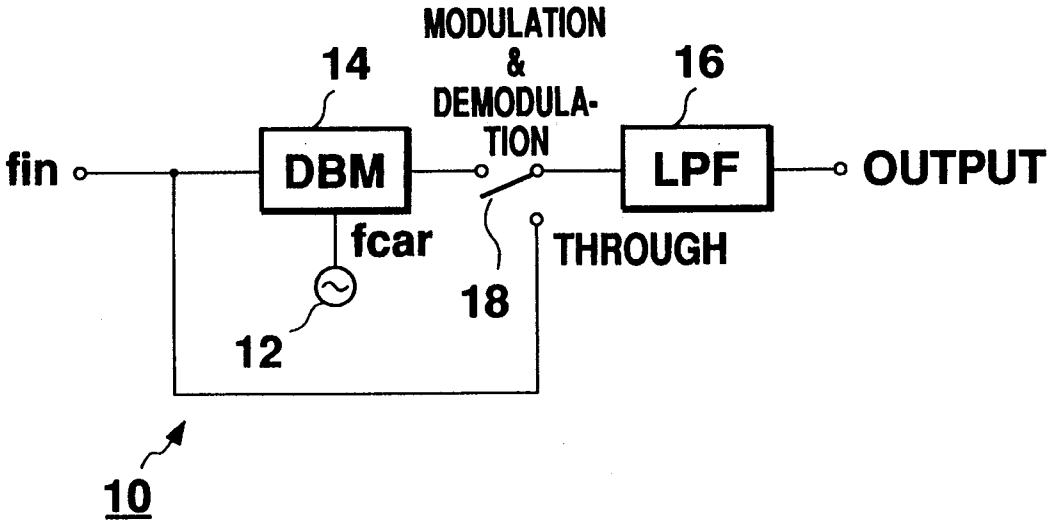
Fig. 6 PRIOR ART
FIG. 6 is a block diagram of a modulation/ demodulation circuit constructed in accordance with the prior art.
Figure 7:
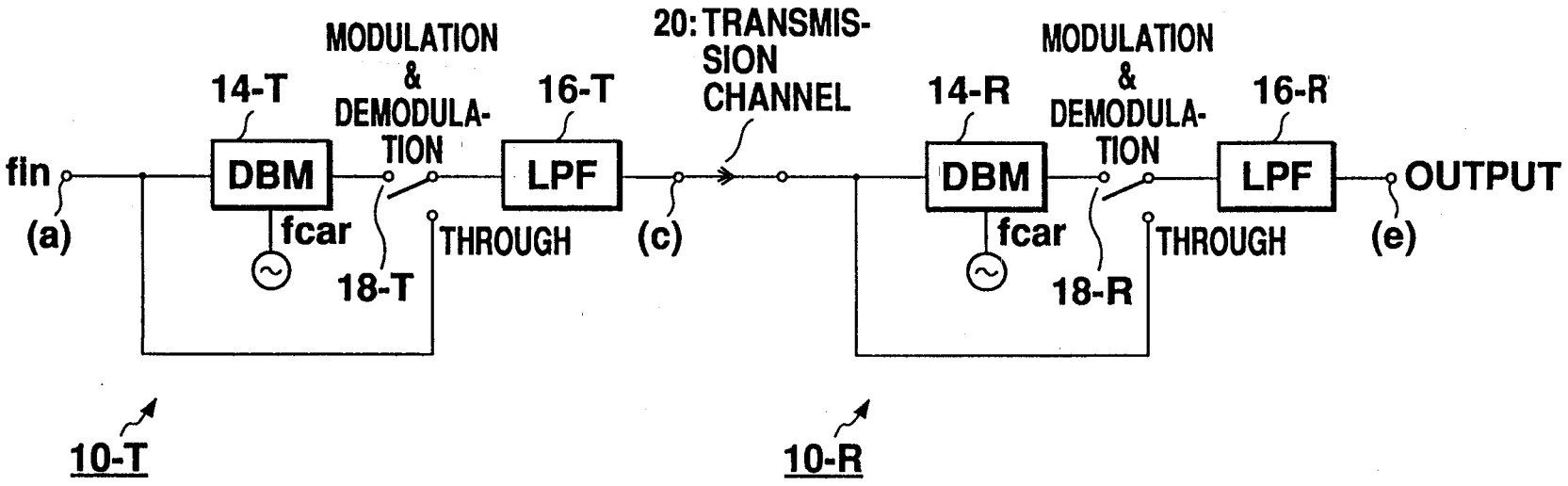
Fig. 7 PRIOR ART
FIG. 7 is a block diagram of a communication system utilizing the modulation/demodulation circuit of the prior art.
Figure 8A:
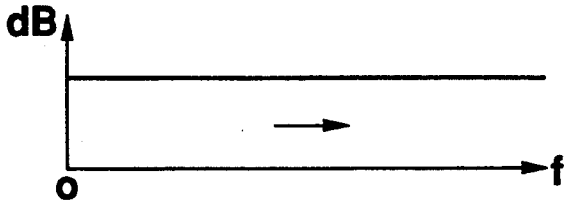
FIGS. 8*a* to 8*e* illustrate the modulation/ demodulation mode in the prior art and present invention, FIG. 8*a* showing the frequency characteristic of the input signal.
Figure 8B:
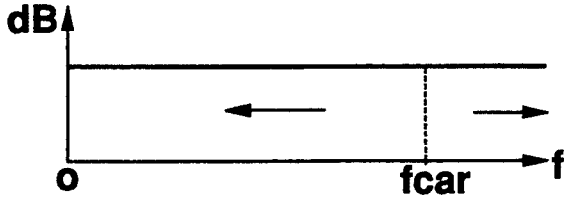
PRIOR ART Fig. 8b
Figure 8C:
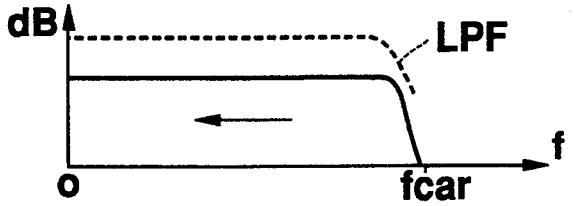
PRIOR ART Fig. 8c
Figure 8D:
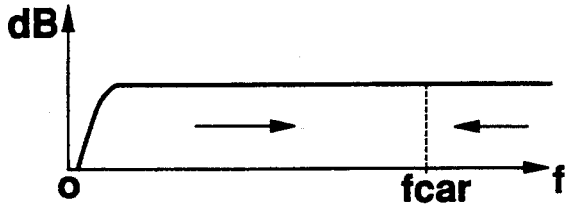
PRIOR ART Fig. 8d
Figure 8E:
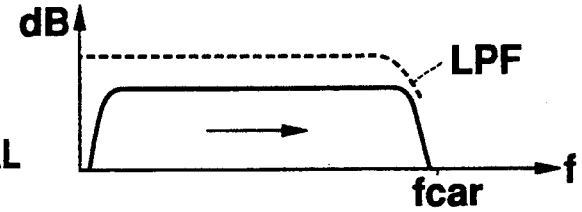
PRIOR ART Fig. 8e

Referring to FIG. 1, there is shown the first embodiment of a modulation/demodulation circuit 22 constructed in accordance with the present invention, which comprises an HPF 24 added to the modulation/-demodulation circuit 10 of the prior art shown in FIG. 6. The HPF 24 is adapted to filter an input signal and to input the filtered signal to the LPF 16 through the switch 18. The characteristic of the HPF 24 is reciprocal to that of the LPF 16. In other words, the HPF 24 has such a low band cutoff characteristic as is provided by frequency inverting the high band cut-off characteristic of the LPF 16.

Figure 2:
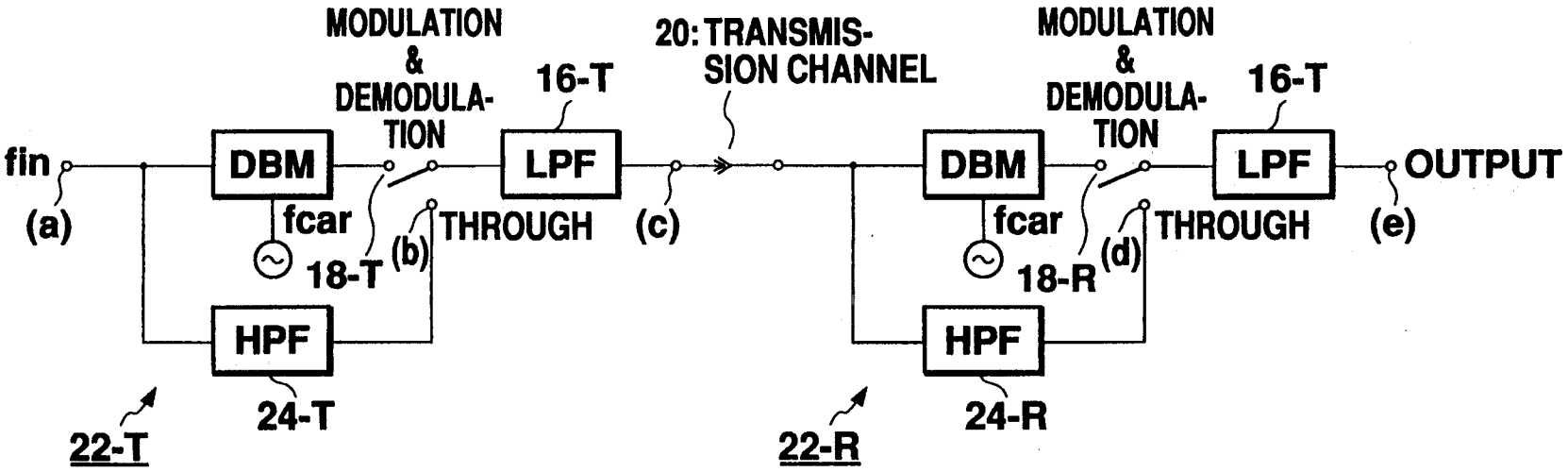
FIG. 2 is a block diagram of a communication system utilizing the modulation/demodulation circuit shown in FIG. 1.

FIG. 2 shows a communication system utilizing the modulation/demodulation circuit 22. The communication system will function as follows:

The modulation/demodulation mode in this embodiment is the same as that of the prior art shown in FIG. 8. This is because the arrangement of this embodiment becomes equal to that of the prior art shown in FIG. 7 when the switches 18-T and 18-R are moved upwardly as viewed in FIG. 2.

Figure 9A:
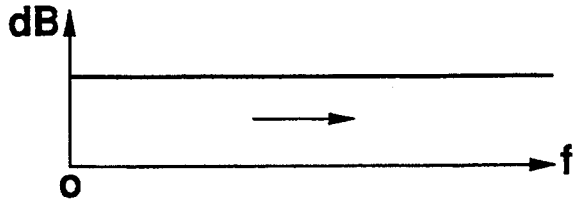
FIGS. 9*a*, 9*b* and 9*c* illustrate the through mode in the prior art, FIG. 9*a* showing the frequency characteristic of the input signal.
Figure 9B:
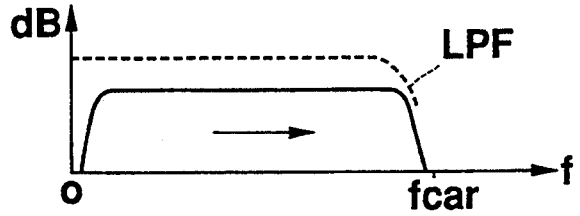
PRIOR ART Fig. 9b
Figure 9C:
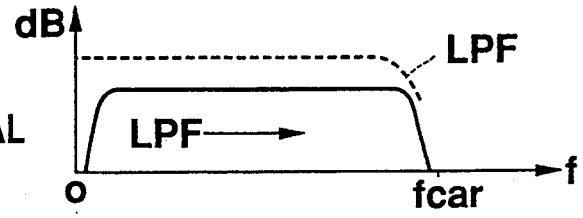
PRIOR ART Fig. 9c

If the switches 18-T and 18-R are moved downwardly, that is, when the system is in the through mode, the mode will be different from that of the prior art as shown in FIG. 9 since the HPF's 24-T and 24-R become operative in the through mode.

Figure 3A:
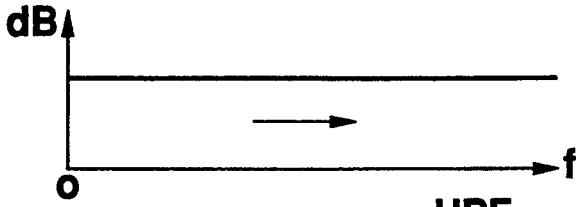
FIGS. 3*a* to 3*e* illustrate the through mode in the first embodiment of the present invention, FIG. 3*a* showing the frequency characteristic of the input signal.
Figure 3B:
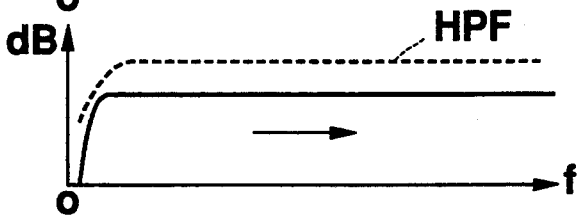

If such an input signal as shown in FIG. 3*a* is provided to the transmission-side modulation/demodulation circuit 22-T, this input signal is first filtered by the HPF 24-T which has such a characteristic as is shown by a broken line in FIG. 3*b*. This is a low band cut-off characteristic. Thus, the output of the HPF 24-T will be a low band cut-off signal.

Figure 3C:
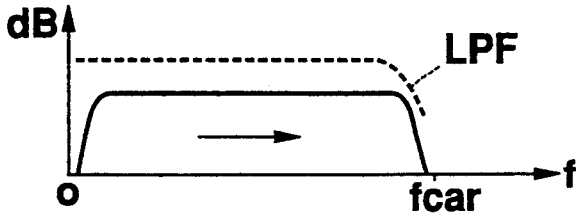

Such an output of the HPF 24-T shown in FIG. 3*b* is inputted to the LPF 16-T through the switch 18-T. The LPF 16-T has such a characteristic as is shown by broken line in FIG. 3*c*. Therefore, the output of the LPF 16.-T will be a high band cut-off signal shown in FIG. 3*c*. Since the low band is cut off at the HPF 24-T, the output of the LPF 16-T becomes a signal having a substantially trapezoid-shaped frequency characteristic.

The low band cut-off due to the LPF 24-T is reciprocal to the high band cut-off due to the LPF 16-T such that they overlap one another when frequency inverted.

Figure 3D:
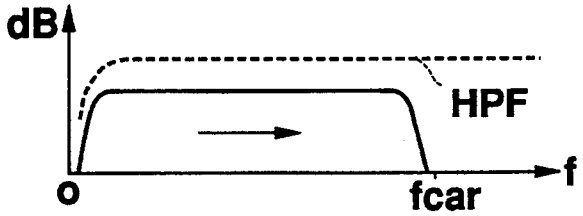
Figure 3E:
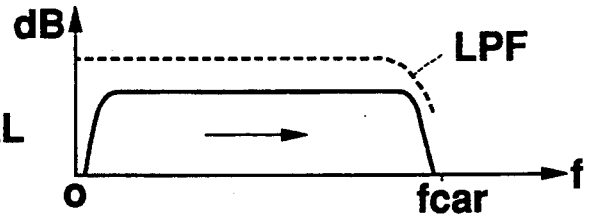

The output of the LPF 16-T is inputted to the HPF 24-R through the transmission channel 20. The HPF 24-R has such a characteristic as is shown by broken line in FIG. 3*d*. The signal filtered by the HPF 24-r is then inputted to the LPF 16-T through the switch 18-R. The LPF 16-R has such a characteristic as is shown by broken line in ;FIG. 3e. Thus, the output of the LPF 16-R will be a trapezoid-shaped signal which is cut off at both the high and low bands.

In such a manner, the output signal from the reception-side modulation/demodulation circuit 22-R in the through mode will have a frequency characteristic similar to that of the output signal in the modulation/-demodulation mode. If this embodiment is applied to a telephone scrambler, therefore, sound quality on scrambling will be no different to that when not scrambling. This can cause the telephone to sound better without any artificiality.

Figure 4:
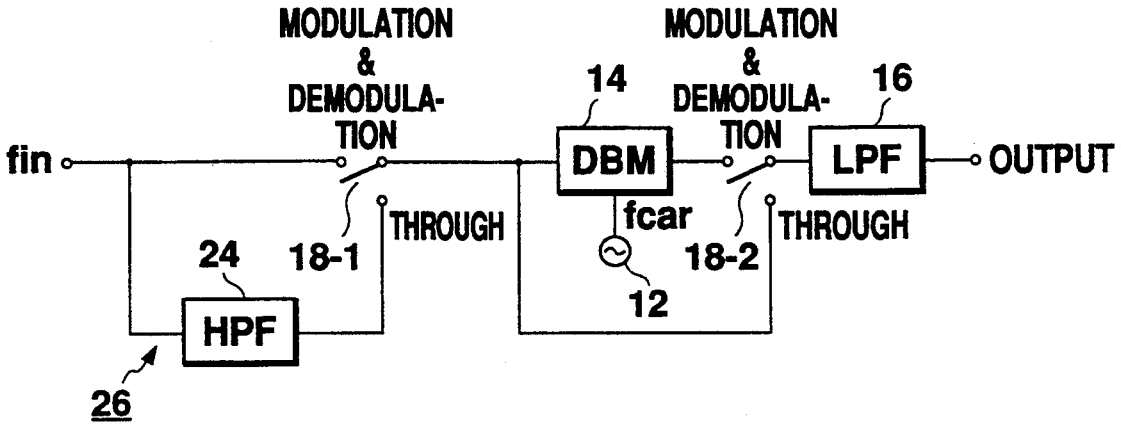
FIG. 4 is a block diagram of the second embodiment of a modulation/demodulation circuit constructed in accordance with the present invention.
Figure 4A:
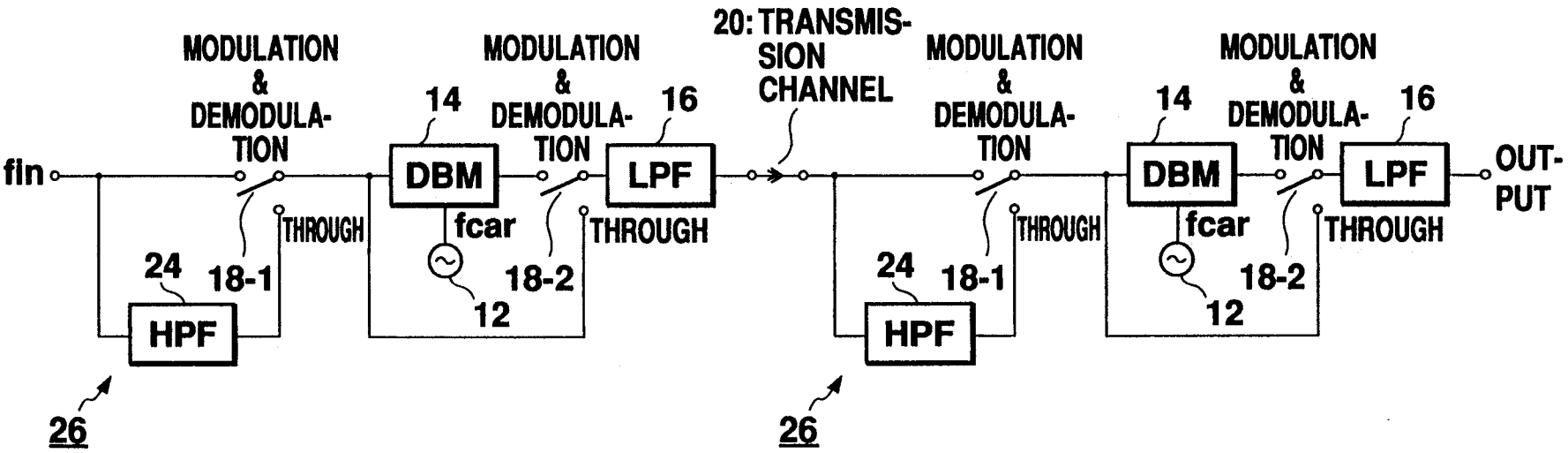
FIG. 4*a* is a block diagram of a communication system utilizing two such modulation/demodulation circuits as shown in FIG. 4.

FIG. 4 shows the second embodiment of a modulation/demodulation circuit 26 constructed in accordance with the present invention. The modulation/demodulation circuit 26 includes a switch 18-1 located at the forward stage of the modulation/demodulation circuit 10 shown in FIG. 6. The switch 18-1 is used to determine whether or not the HPF 24 is inserted into the circuit. Another switch 18-2 is located at the output stage of the DBM 14 so as to determine whether the output of the DBM 14 is applied to the LPF 16 or the output of the switch 18-1 is provided directly to the LPF 16, not through the DBM 14. These switches 18-1 and 18-2 are manually switched by an operator. If the switches 18-1 and 18-2 are moved upwardly as viewed in FIG. 4, the circuit is placed in the modulation/-demodulation mode. If they are moved downwardly, the circuit is brought into the through mode. The frequency characteristic of the output signal obtained in the through mode is similar to that of the first embodiment with similar advantages. Such two modulation/-demodulation circuits may be used to form a communication system as shown in FIG. 4*a*.

Figure 5:
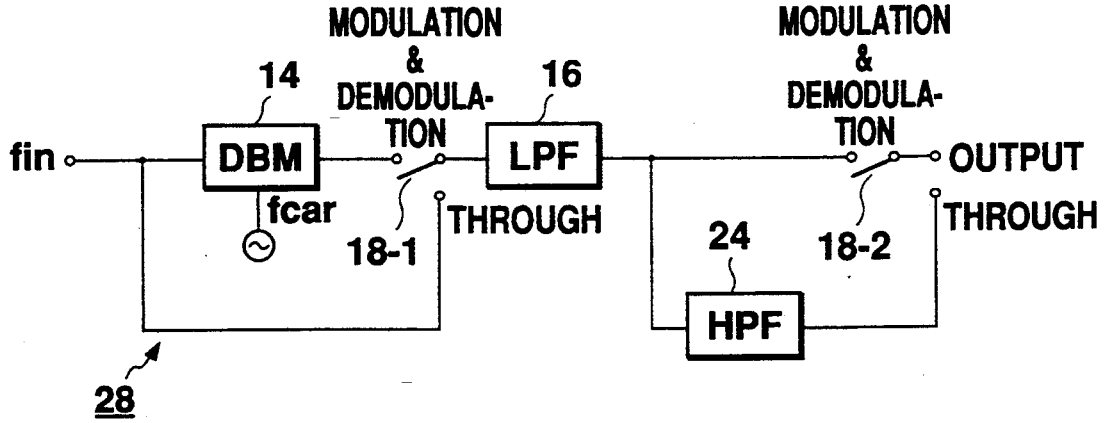
FIG. 5 is a block diagram of the third embodiment of an modulation/demodulation circuit constructed in accordance with the present invention.
Figure 5A:
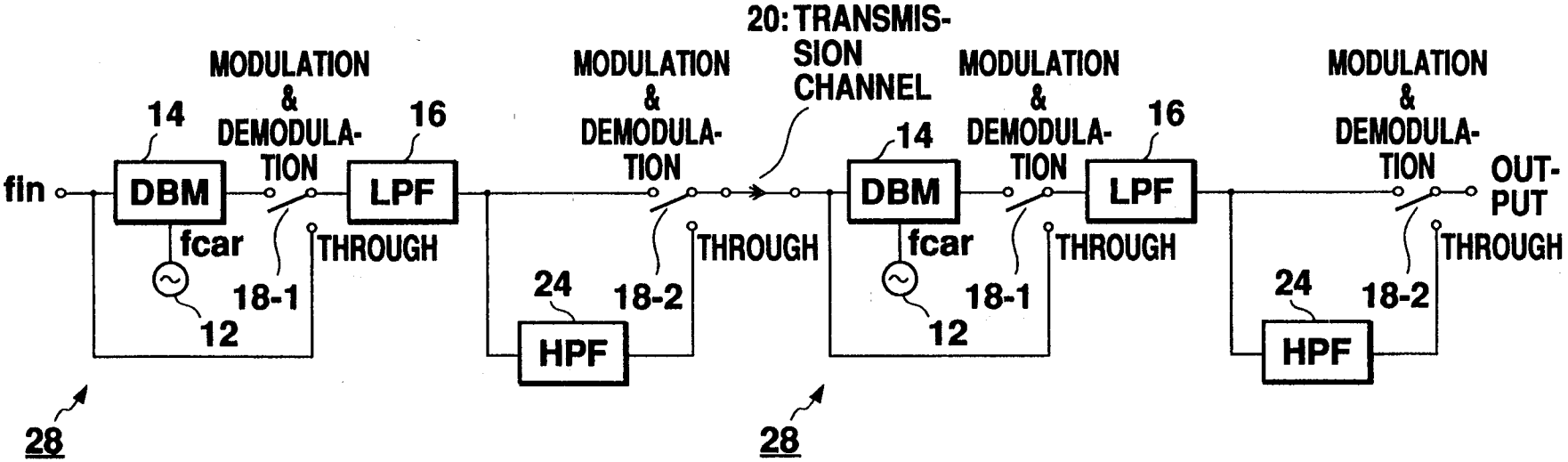
FIG. 5*a* is a block diagram of a communication system utilizing two such modulation/demodulation circuits as shown in FIG. 5.

FIG. 5 shows the third embodiment of a modulation/demodulation circuit 28 constructed in accordance with the present invention, which includes HPF 24 and switch 18-2 disposed at the output stage of the modulation/ demodulation circuit 10 shown in FIG. 6. More particularly, the output of the LPF 16 is outputted directly in the modulation/demodulation mode and through the HPF 24 in the through mode. Therefore, the third embodiment also provides advantages similar to those of the first and second embodiments. Two such modulation/demodulation circuits may be used to form such a communication system as is shown in FIG. 5*a*.

The present invention is not limited to a telephone scrambler, but may be applied to any other system which comprises a suitable modulation/demodulation circuit which uses DBM means and is adapted to switch the modulation/demodulation and through modes from one to another. If it is desired to realize the modulation/ demodulation circuit of the present invention as a telephone scrambler, the transmission-side and reception-side scrambling modulation/demodulation circuits may be preferably constructed as one IC unit. The IC unit is used for each of a main unit and a sub unit of the wireless telephone system.

As will be apparent from the foregoing, the present invention can provide the output signal from the reception-side modulation/demodulation circuit having the same frequency characteristic in both the modulation/-demodulation and through modes since the system of the present invention utilizes HPF means having the frequency characteristic reciprocal to that of LPF means and the signal filtered by these HPF and LPF means is to be outputted from the system in the through mode. Therefore, any disadvantages such as change of sound quality, artificial sounding voice and the like may be eliminated.

What is claimed is:

1. A communication system comprising:

A) a transmission-side device comprising:

a) a transmission-side frequency inverting means comprising:

a transmission-side mixing circuit for mixing an input signal with a carrier frequency signal to form a mixed signal; and a transmission-side low-pass filter for separating a lower side band from the mixed signal of said transmission-side mixing circuit, the lower side band having a frequency spectrum inverted relative to the input signal, b) a transmission-side high-pass filter having a low range cut-off reciprocal to a cut-off of said transmission-side low pass filter, and c) transmission-side selecting means for selecting and transmitting an output signal by frequency inverting said input signal with said transmission-side frequency inverting means and by passing the frequency inverted input signal through the transmission side low-pass filter in a modulation mode and for selecting and transmitting the output signal by filtering said input signal with the transmission-side low-pass filter and the transmission-side high-pass filter in a through mode, and B) a reception-side device comprising:

d) a reception-side frequency inverting means for inverting a frequency spectrum of the output signal transmitted from said transmission-side device; and e) a reception-side selecting means for causing said reception-side frequency inverting means to frequency invert the transmitted output signal only in a demodulation mode.

2. A communication system as defined in claim 1, wherein said transmission-side frequency inverting means includes an oscillator oscillating at a carrier frequency.

3. A communication system as defined in claim 1, wherein said transmission-side mixing circuit includes a double balanced mixer for mixing the input signal having an input frequency with the high frequency carrier signal having a carrier frequency to form the mixed signal having an upper side band with a first frequency and a lower side band with a second frequency.

4. A communication system as defined in claim 1, wherein the low band cut-off of said transmission-side high pass filter is provided by converting a frequency axis of said transmission-side low pass filter.

5. A communication system as defined in claim wherein said transmission-side selecting means includes switch means, located between said transmission-side mixing circuit and said transmission-side low pass filter and located between said transmission-side high-pass filter and said transmission-side low-pass filter, said switch means causing said input signal to only pass through said transmission-side mixing circuit in the modulation mode and causing said input signal to only pass through said transmission-side high pass filter in the through mode.

6. A communication system as defined in claim 1, wherein said transmission-side selecting means comprises:

a first switch located at a forward stage of said transmission-side frequency inverting means, said first switch inputting said input signal to said transmission-side frequency inverting means in the modulation mode and passing the input signal through said transmission-side high pass filter in the through mode; and a second switch disposed between said transmission-side mixing circuit and said transmission-side low pass filter, said second switch causing said transmission-side low pass filter to receive the mixed signal from said transmission-side mixing circuit in the modulation mode and receive an output of said transmission-side high pass filter in the through mode.

7. A communication system as defined in claim 1, wherein said transmission-side selecting means comprises:

a first switch disposed between said transmission-side mixing circuit and said transmission-side low pass filter, said first switch causing said transmission-side low pass filter to receive the mixed signal from said transmission-side mixing circuit in the modulation mode and receive said input signal in the through mode; and a second switch located at an output stage of said transmission-side frequency inverting means, said second switch forming the output signal from an output of said transmission-side low pass filter in the modulation mode and forming the output signal from the input signal filtered by said transmission-side low pass filter in the through mode.

8. A communication system as defined in claim 1, wherein said reception-side frequency inverting means includes an oscillator oscillating at a carrier frequency.

9. A communication system as defined in claim 1, wherein said reception-side frequency inverting means comprises:

a reception-side mixing circuit for mixing the transmitted output signal with a reception-side carrier frequency signal to form a received signal; and a reception-side low pass filter for passing the lower side band from the transmitted output signal, the reception-side low pass filter having a frequency spectrum inverted relative to the transmitted output signal.

10. A communication system as defined in claim 9, wherein said reception-side mixing circuit includes a double balanced mixer for mixing the transmitted output signal with the reception-side carrier frequency signal having a carrier frequency to form a signal having an upper side band having a first frequency and a lower side band having a second frequency.

11. A communication system as defined in claim 9, wherein said reception-side device includes a reception-side high pass filter having a low band cut-off reciprocal to said reception-side low pass filter.

12. A communication system as defined in claim 11, wherein the low band cut-off of said reception-side high pass filter is provided by converting a frequency axis of said reception-side low pass filter.

13. A communication system as defined in claim 11, wherein said reception-side selecting means comprises means for selecting and outputting a signal provided by frequency inverting the transmitted output signal from said transmission-side device using said reception-side frequency inverting means in the modulation mode and for selecting and outputting a signal filtered by said reception-side low and high pass filters in the through mode.

14. A communication system as defined in claim 13, wherein said reception-side selecting means includes switch means located between said transmission-side mixing circuit and said transmission-side low pass filter, said switch means causing the transmitted output signal to be received by said reception-side low pass filter through said reception-side mixing circuit in the modulation mode and causing the transmitted output signal to be received by said reception-side low pass filter through said reception-side high pass filter in the through mode.

15. A communication system as defined in claim 14, wherein said reception-side selecting means comprises:

a first switch disposed between said reception-side mixing circuit and said reception-side low pass filter, said first switch causing said reception-side low pass filter to receive an output of said reception-side mixing circuit in the modulation mode and causing the reception-side low pass filter to receive the transmitted output signal from said transmission-side device in the through mode; and a second switch located at a rearward stage of said reception-side frequency inverting means, said second switch forming a reception signal from an output of said reception-side low pass filter in the modulation mode and forming the reception signal from the signal filtered by said reception-side low pass filter in the through mode.

16. A communication system as defined in claim 13, wherein said reception-side selecting means comprises:

a first switch located at the forward stage of said reception-side frequency inverting means, said first switch causing the transmitted output signal to be received by said reception-side frequency inverting means in the modulation mode and causing the transmitted output signal to pass through said reception-side high pass filter in the through mode; and a second switch disposed between said reception-side mixing circuit and said reception-side low pass filter, said second switch causing said reception-side low pass filter to receive an output of said reception-side mixing circuit in the modulation mode and causing the reception-side low pass filter to receive an output of said reception-side high pass filter in the through mode.

17. A modulation/demodulation circuit comprising:

a) a frequency inverting means including:

a mixing circuit for mixing an input signal with a high frequency signal to produce a mixed signal; and a low pass filter for passing the lower side band of the mixed signal as an input signal, the low pass filter having a frequency spectrum inverted relative to a frequency spectrum of the input signal, b) a high pass filter having a low band cut-off reciprocal to a cut-off of said low pass filter, and c) means for selecting and outputting an output signal by frequency inverting the input signal in a modulation mode and for selecting and outputting an output signal filtered by said low pass filter and said high pass filter in a through mode.

18. A modulation/demodulation circuit as defined in claim 17, wherein said frequency inverting means includes an oscillator oscillating at a first frequency.

19. A modulation/demodulation circuit as defined in claim 17, wherein said mixing circuit includes a double balanced mixer for mixing the input signal having an initial frequency with a signal having a carrier frequency to form a signal having an upper side band having a second frequency and a lower side band having a third frequency.

20. A modulation/demodulation circuit as defined in claim 17, wherein the low band cut-off of said high pass filter is provided by converting a frequency axis of said low pass filter.

21. A modulation/demodulation circuit as defined in claim 17, wherein said selecting means includes switch means located between said mixing circuit and said low pass filter, said switch means causing said input signal to be received by said low pass filter through said mixing circuit in the modulation mode and causing said input signal to be received by said low pass filter through said high pass filter in the through mode.

22. A modulation/demodulation circuit as defined in claim 17, wherein said selecting means comprises:

a first switch located at a forward stage of said frequency inverting means, said first switch causing said input signal to be directly received by said frequency inverting means in the modulation mode and causing the input signal to be received by the frequency inverting means through said high pass filter in the through mode; and a second switch disposed between said mixing circuit and said low pass filter, said second switch causing said low pass filter to receive the mixed signal from said mixing circuit in the modulation mode and receive an output signal of said high pass filter in the through mode.

23. A modulation/demodulation circuit as defined in claim 17, wherein said selecting means includes:

a first switch disposed between said mixing circuit and said low pass filter, said first switch causing said low pass filter to receive the mixed signal from said mixing circuit in the modulation mode and causing the low pass filter to receive said input signal in the through mode; and a second switch located at an output stage of said frequency inverting means, the second switch causing an output of said low pass filter to pass as the output signal in the modulation mode and causing the output of said low pass filter to pass through the high pass filter and form the output signal in the through mode.

24. A voice scrambler comprising:

a) means for frequency inverting and scrambling a voice signal, comprising:

a double balanced modulator for converting the voice signal into a signal having upper and lower side bands; and a low pass filter permitting only said lower side band to pass therethrough, b) a high pass filter having a low band cutoff reciprocal to a cut-off of said low pass filter, c) means for determining whether the voice signal is frequency inverted and scrambled and for determining whether the voice signal is filtered by said low pass filter and said high pass filter without being frequency inverted and scrambled, and d) means for outputting one of the voice signal frequency inverted and scrambled and the voice signal filtered by said low pass filter and the high pass filter to a transmission channel.

25. A voice descrambler comprising:

a) means for frequency inverting and descrambling an input signal, comprising:

a double balanced modulator for converting the voice signal into a signal having upper and lower side bands; and a low pass filter permitting only said lower side band to pass therethrough, b) a high pass filter having a low band cut-off reciprocal to a cut-off of said low pass filter, c) means for receiving a frequency inverted and scrambled signal from a transmission channel, for forming an output voice signal by frequency inverting and descrambling said frequency inverted and scrambled signal, for receiving a not frequency inverted and scrambled signal from the transmission channel and for forming the output voice signal by filtering said not frequency inverted and scrambled signal with said low and high pass filters.

* * * * *